US006805091B2

(12) United States Patent
Esteghlal

(10) Patent No.: US 6,805,091 B2
(45) Date of Patent: Oct. 19, 2004

(54) METHOD FOR DETERMINING THE FUEL CONTENT OF THE REGENERATION GAS IN AN INTERNAL COMBUSTION ENGINE COMPRISING DIRECT FUEL-INJECTION WITH SHIFT OPERATION

(75) Inventor: Gholamabas Esteghlal, Ludwigsburg (DE)

(73) Assignee: Robert Bosch GmbH, Stuttgart (DE)

( * ) Notice: Subject to any disclaimer, the term of this patent is extended or adjusted under 35 U.S.C. 154(b) by 109 days.

(21) Appl. No.: 10/129,430

(22) PCT Filed: Sep. 3, 2001

(86) PCT No.: PCT/DE01/03321

§ 371 (c)(1),
(2), (4) Date: Aug. 20, 2002

(87) PCT Pub. No.: WO02/20961

PCT Pub. Date: Mar. 14, 2002

(65) Prior Publication Data

US 2003/0029427 A1 Feb. 13, 2003

(30) Foreign Application Priority Data

Sep. 4, 2000 (DE) ..... 100 43 699

(51) Int. Cl.[7] ..... F02M 25/08; F02D 41/14
(52) U.S. Cl. ..... 123/295; 123/520; 123/698
(58) Field of Search ..... 123/295, 520, 123/698

(56) References Cited

U.S. PATENT DOCUMENTS 5,765,541 A * 6/1998 Farmer et al. ..... 123/520
6,622,691 B2 * 9/2003 Bagnasco et al. ..... 123/295

FOREIGN PATENT DOCUMENTS

| | | |
|---|---|---|
| DE | 38 13 220 | 11/1989 |
| DE | 197 27 297 | 1/1999 |
| DE | 198 50 586 | 5/2000 |
| DE | 198 51 990 | 6/2000 |
| EP | 0 947 687 | 10/1999 |

* cited by examiner

*Primary Examiner*—Tony M. Argenbright
(74) *Attorney, Agent, or Firm*—Kenyon & Kenyon

(57) ABSTRACT

A method for determining the fuel content of a regeneration gas during regeneration of an intermediate fuel vapor storage unit in internal combustion engines with gasoline direct injection in lean (stratified) mode. Stored fuel vapor is supplied to the engine as regeneration gas via a controllable tank venting valve. The signal of an exhaust gas analyzer probe in the exhaust gas is considered for determining the fuel content of the regeneration gas. An adjustment between the analyzer probe signal and a preselected setpoint occurs while the tank venting valve is closed. The analyzer probe signal is combined with a correction quantity while the tank venting valve is closed, so that the combination corresponds to the setpoint. The analyzer probe signal is combined in the same manner with the previously obtained correction valve while the tank venting value is open. Regeneration gas charge is determined from this combination.

16 Claims, 2 Drawing Sheets

METHOD FOR DETERMINING THE FUEL CONTENT OF THE REGENERATION GAS IN AN INTERNAL COMBUSTION ENGINE COMPRISING DIRECT FUEL-INJECTION WITH SHIFT OPERATION

FIELD OF THE INVENTION

The present invention relates to the technical background of tank venting in internal combustion engines with gasoline direct injection.

BACKGROUND INFORMATION

Engines having gasoline direct injection may be operated in both stratified mode and homogeneous mode.

An engine control program that controls switching between the two modes of operation is described in German Published Patent Application No. 198 50 586.

In stratified mode, the engine is operated with a highly stratified cylinder charge and a very lean mixture to minimize fuel consumption. The stratified charge is achieved by late fuel injection, which divides the combustion chamber into two zones: The first zone contains a combustible air/fuel mixture cloud near the spark plug. It is surrounded by the second zone, which includes an insulating layer of air and residual gas. The potential for optimizing consumption derives from the ability to operate the engine largely unthrottled, thus avoiding charge cycle losses. Stratified operation may be performed when loads are comparatively low.

At higher loads, when performance optimization is important, the engine is operated using a homogeneous cylinder charge. This homogeneous cylinder charge results from early fuel injection during intake. This results in a longer interval between combustion and mixture formation. The potential of this mode to optimize performance derives, for example, from its ability to utilize the entire combustion chamber volume for filling with combustible mixture.

Varying amounts of fuel vapor per time unit exist in the fuel tank of a vehicle, depending on fuel temperature, fuel type and pressure ratios. A method is conventional known for first storing this fuel vapor in an active charcoal filter and then supplying it, mixed with air, to the engine combustion system via a controllable tank venting valve during operation of the internal combustion engine. The active charcoal filter thus becomes able again to absorb additional fuel vapor (regeneration). The fuel vapor that has been mixed with air is referred to as regeneration gas.

To compensate for the amount of fuel flowing via the tank venting valve, the amount of fuel flowing via the injectors is reduced. In this connection, a method for obtaining a measure FTEAD of the fuel content of the regeneration gas from known quantities in the control unit, including the fuel flow via the injectors, the quantity of regeneration gas when the tank venting valve is open, the intake air quantity of the engine and the signal of an exhaust gas analyzer probe, is described in German Published Patent Application No. 38 13 220 for engines with intake-manifold injection. The obtained measure serves to adjust the reduction in fuel flow via the injectors with the fuel flow via the tank venting valve, with the goal of controlling the composition of the entire air/fuel mixture. During operation of an engine with intake-manifold injection, the combustion chamber is homogeneously filled with mixture, just like during operation of an engine with gasoline direct injection in homogeneous mode.

It is therefore possible to use tank venting control in this mode, as is conventional from the field of intake-manifold injection.

During operation of an engine with gasoline direct injection in stratified mode, on the other hand, disturbances tend to occur when controlling the entire air/fuel mixture with an open tank venting valve.

It is an object of the present invention to eliminate such disturbances and thus improve predictability of the effect of tank venting on the mixture composition in stratified mode.

SUMMARY

Specifically, the determination according to the present invention of the fuel content of a regeneration gas during regeneration of an intermediate fuel vapor storage unit in internal combustion engines having gasoline direct injection in lean (stratified) mode, in which the stored fuel vapor is supplied to the internal combustion engine in the form of regeneration gas via a controllable tank venting valve, and in which the signal of an exhaust gas analyzer probe in the exhaust gas of the internal combustion engine is taken into account to determine the fuel content, includes the following steps:

- Adjustment between the exhaust gas analyzer probe signal and a preselected setpoint when the tank venting valve is closed, with the exhaust gas analyzer probe signal being combined with a correction quantity when the tank venting valve is closed so that the result of the combination corresponds to the setpoint.
- Combination of the exhaust gas analyzer probe signal in the same manner with the correction value obtained earlier while the tank venting valve is open; and
- Determination of the regeneration gas charge based on the result of the combination.

The present invention is based on the concept that, in stratified mode, the measured lambda value may vary to a comparatively large degree from the physical lambda value.

Possible causes include probe manufacturing tolerances, aging effects and greatly fluctuating exhaust gas temperatures in stratified mode with unregulated probe heating. Regardless of the cause at hand, a deviation nevertheless occurs between the probe signal and the actual lambda value.

It is an object of the present invention to adjust the probe signal in stratified mode with the tank venting valve closed. This decouples the probe signal from the absolute lambda value. If the regeneration gas additionally has an effect when the tank venting valve is open, this effect may be determined from the relative change in the probe signal.

According to one example embodiment of the present invention, a measured lambda value (measured lambda) is formed from the exhaust gas analyzer probe signal, and the difference of the measured lambda value is determined from the product of the adjustment factor and the difference of the lambda setpoint (setpoint lambda) from value 1 and integrated.

According to another example embodiment, the adjustment factor in the steady state corresponds to the average quotient $$(\text{measured lambda}-1)/(\text{setpoint lambda}-1).$$

With this function, fluctuations in the measured lambda are averaged out through the integration process during adjustment, thus preventing corruption of the adjustment factor.

According to a further example embodiment, the actual lambda is determined by the following equation during operation with an open tank venting valve:

$$\text{Actual lambda}=(1/\text{adjustment factor})*(\text{measured lambda}-1)+1$$

According to a further example embodiment, a new adjustment is performed in stratified mode upon a change in the operating point of the internal combustion engine or when certain ambient conditions change.

According to a further example embodiment, the ambient temperature and the altitude at which the engine is operated are ambient conditions of this type.

According to a further example embodiment, a change in the operating point is defined by a minimum change in the lambda setpoint.

According to a further example embodiment, an adjustment ends when the absolute value of the integrator input drops below a predetermined threshold value.

The present invention also relates to an electronic control unit for performing at least one of the methods and example embodiments described above.

One example embodiment of the present invention is explained below on the basis of the drawings.

DETAILED DESCRIPTION

Figure 1:
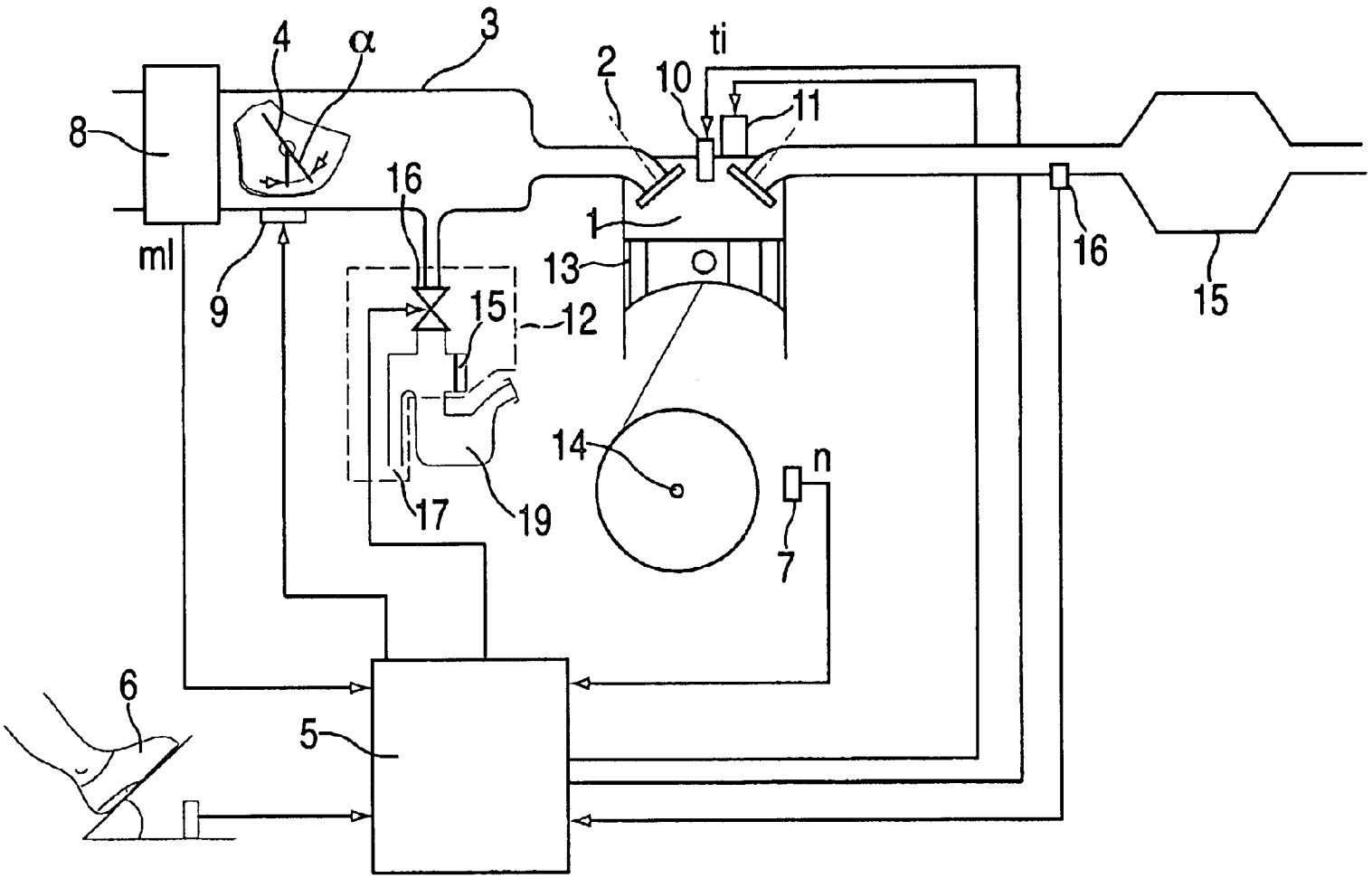
FIG. 1 illustrates the technical background of the present invention.

Reference number 1 in FIG. 1 represents the combustion chamber of a cylinder of an internal combustion engine. The inflow of air into the combustion chamber is controlled by an intake valve 2. The air is drawn in via an intake manifold 3. The intake air volume may be varied by a throttle valve 4, which is controlled by a control unit 5. Signals corresponding to a torque request by the driver, for example, the position of a gas pedal 6, a signal corresponding to engine speed n of an engine speed sensor 7, and a signal indicating the volume ml of intake air from an air-flow sensor 8 are supplied to the control unit, and a signal Us indicating the exhaust gas composition and/or exhaust gas temperature is supplied by an exhaust gas sensor 16. Exhaust gas sensor 16 may be, for example, a lambda probe, whose Nernst voltage or pump current (depending on the probe type) specifies the exhaust gas oxygen content. The exhaust gas is conducted through at least one catalytic converter 15, which converts pollutants from the exhaust gas and/or stores them temporarily.

Control unit 5 forms output signals from these and possibly other input signals corresponding to other internal combustion engine parameters, such as intake air and coolant temperature, for the purpose of setting throttle valve angle alpha by an actuator 9 and for the purpose of controlling a fuel injector 10, thereby metering the fuel to the engine combustion chamber. The control unit also controls ignition triggering via ignition unit 11.

Throttle valve angle alpha and injection pulse width ti may be important manipulated variables to be tuned to each other for achieving the desired torque. A further important manipulated variable for influencing torque may be the angular ignition angle relative to piston movement. The determination of the manipulated variables for setting torque is the subject matter of German Published Patent Application No. 198 51 990, which is expressly incorporated herein in its entirety by reference thereto.

The control unit also controls a tank venting system 12 as well as other functions for achieving efficient combustion of the air/fuel mixture in the combustion chamber. The gas force resulting from combustion is converted to a torque by piston 13 and crank mechanism 14.

Tank venting system 12 includes an active charcoal filter 15, which communicates via corresponding lines or connections with the tank, ambient air and intake manifold of the internal combustion engine, with a tank venting valve 16 being provided in the line to the intake manifold.

Active charcoal filter 15 stores fuel vaporizing in tank 5. As tank venting valve 11 is opened by control unit 6, air is drawn in from environment 17 through the active charcoal filter, which releases the stored fuel into the air. This air/fuel mixture, which is also referred to as tank venting mixture or regeneration gas, affects the composition of the entire mixture supplied to the internal combustion engine. The fuel component of the mixture is further determined by metering fuel via fuel metering device 10, which is adjusted to the intake air rate. In extreme cases, the fuel drawn in via the tank venting system may be in a proportion of approximately one third to one half of the total fuel volume.

Figure 2:
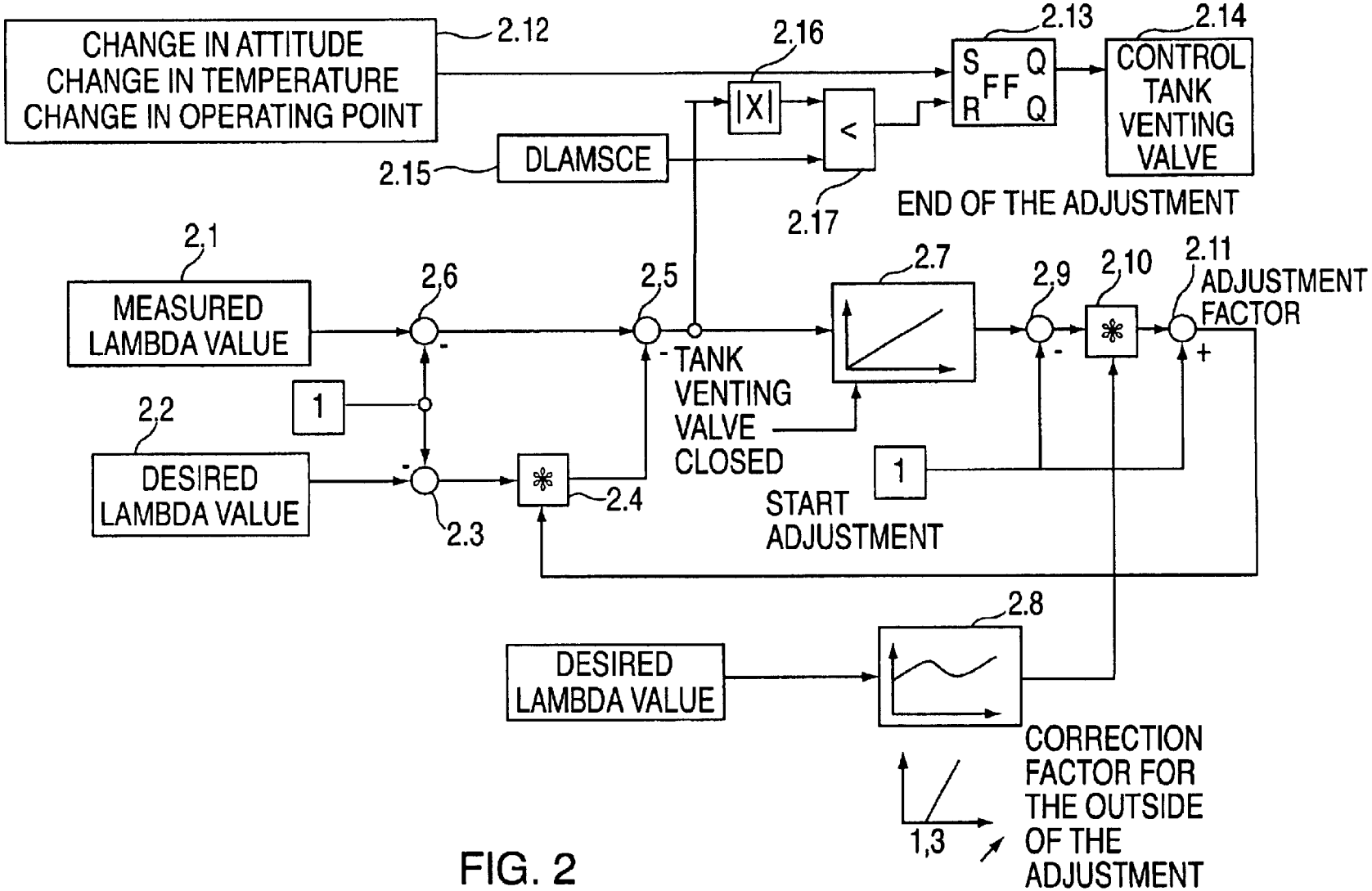
FIG. 2 illustrates an example embodiment of the present invention in the form of function blocks.

FIG. 2 is a function block diagram of the method according to the present invention.

The initial prerequisites are a closed tank venting valve and a stationary operating state.

Block 2.1 provides the measured lambda value obtained from signal Us of the exhaust gas analyzer probe. Block 2.2 provides the setpoint for composition Lambda of the entire mixture combusted by the internal combustion engine. Block 2.3 forms the difference between the setpoint and value 1. This difference is combined with an adjustment factor in block 2.4. Block 2.5 forms the difference between the measured lambda value and value 1. Block 2.6 determines the deviation between the difference in the measured lambda value and the product of the adjustment factor and the difference between the lambda setpoint and value 1. This deviation is supplied to an integrator 2.7. Block 2.8 supplies a correction value for operating points in the vicinity of the operating point where the adjustment occurs. Assuming a steady operating state, as described above, block 2.8 supplies value 1, so that the output value of integrator 2.7 is not changed by the result of the combinations in blocks 2.9 through 2.11.

In this case, the integrator output value is returned directly as the adjustment factor and combined with the desired lambda setpoint.

This structure has the following function:

As long as the product of the adjustment factor and the deviation between the desired lambda value and 1 is less than the deviation between the measured lambda value and 1, the integrator input is positive, and the integrator output increases. The adjustment factor is thereby increased. This increases the product mentioned above. As a result, the interval between the product and the deviation between the measured lambda value and 1 decreases. The integrator input becomes smaller. The integrator output increases at a slower rate.

If the integrator output becomes too large, the feedback changes the sign of the integrator input, and the integrator output is subsequently reduced.

As a result, the adjustment factor in the transient state corresponds to a certain extent to the average quotient (measured lambda−1)/(setpoint lambda−1).

With this function, fluctuations in the measured lambda may be averaged out through the integration process during adjustment, thus preventing corruption of the adjustment factor.

During operation with an open tank venting valve, the actual lambda may be determined by the following equation:

Actual lambda=(1/adjustment factor)*(measured lambda−1)+1

The actual lambda is proportionate to the quotient of the entire air volume and entire fuel volume.

The entire air volume includes the air volume flowing via the throttle valve and the air component of the regeneration gas from the tank venting system. The air component of the regeneration gas is more or less equivalent to the regeneration gas volume. The latter may be derived from known quantities in the control unit, such as intake manifold pressure and control pulse-duty factor. The air component is therefore known. The same is true for the air volume flowing via the throttle valve, which is detectable, for example, by a hot-film air mass meter. The fuel volume flowing via the injectors may be derived from the control pulse widths and the pressure in the fuel system, i.e., from known quantities.

The fuel component of tank venting in the method according to the present invention may therefore also be determined in stratified mode from the measured lambda value using the adjustment factor.

Blocks 2.12 through 2.17 represent a structure for activating the adjustment. A new adjustment in stratified mode occurs upon a change in the operating point of the internal combustion engine or upon a change in certain ambient conditions. Examples of such ambient conditions are ambient temperature, which may be provided, for example, by an intake air temperature sensor, and the altitude at which the engine is operated. Information about this altitude is available in modern engine controllers. It is determined, for example, from the signal of an ambient pressure sensor or calculated from the detected load (intake air volume, cylinder charge). A change in the operating point is also definable, for example, as a minimum change in the lambda setpoint, for example by a minimum value of 0.3. If one of these conditions occurs, block 2.12 causes the tank venting valve to close in block 2.14 via flip-flop 2.13 and starts integrator 2.7.

Blocks 2.15 through 2.17 detect the end of the adjustment. Block 2.15 provides a threshold value DLAMSCE, and block 2.16 supplies the positive absolute value of the integrator input. If this value drops below the specified-threshold value, block 2.17 detects this condition and cancels the command to close the tank venting valve by resetting flip-flop 2.13.

Blocks 2.8 through 2.11 make it possible to take into account minor changes in the lambda setpoint that do not represent a change in the operating point in the above sense.

The relationship between the probe voltage and the lambda value is generally nonlinear.

A new adjustment thus occurs in the event of major changes in the lambda setpoint (change in operating point). In the event of minor lambda setpoint changes, block 2.7 supplies a correction quantity instead, for example on the basis of a computerized linearization of the relationship between Us and lambda setpoint an environment of the adjusted operating point.

What is claimed is:

1. A method for determining a fuel content of a regeneration gas upon regeneration of an intermediate fuel vapor storage unit in an internal combustion engine, comprising:

performing gasoline direct injection in lean mode;

supplying stored fuel vapor to the internal combustion engine in the form of the regeneration gas via a controllable tank venting valve;

determining the fuel content of the regeneration gas in accordance with a signal of an exhaust gas analyzer probe in an exhaust gas of the internal combustion engine;

performing, with a closed tank venting valve, an adjustment between the signal of the exhaust gas analyzer probe and a preselected setpoint in which the exhaust gas analyzer probe signal is combined with a correction quantity while the tank venting valve is closed so that a result of the combination corresponds to the setpoint;

combining, with an open tank venting valve, the exhaust gas analyzer probe signal with the correction quantity; and determining a regeneration gas charge from the result of the combination.

2. The method according to claim 1, further comprising the steps of:

forming a measured lambda value from the exhaust gas analyzer probe signal; and determining and integrating a difference of the measured lambda value from a product of an adjustment factor and a difference of a lambda setpoint from value 1.

3. The method according to claim 2, wherein the adjustment factor in a steady state corresponds to an average quotient in accordance with:

(measured lambda value−1)/(lambda setpoint value−1).

4. The method according to claim 2, further comprising the step of determining an actual lambda in accordance with the following equation during operation with the open tank venting valve:

actual lambda=(1/adjustment factor)*(measured lambda value−1)+1.

5. The method according to claim 1, farther comprising the step of performing an adjustment in stratified mode upon one of a change in an operating point of the internal combustion engine and a change in ambient conditions.

6. The method according to claim 5, wherein the ambient conditions include an ambient temperature and an elevation at which the internal combustion engine is operated.

7. The method according to claim 5, wherein the change in the operating point includes a minimum change in a lambda setpoint.

8. The method according to claim 2, further comprising the step of completing an adjustment when an absolute value of an integrator input drops below a preselected threshold value.

9. An electronic control system configured to perform a method for determining a fuel content of a regeneration gas upon regeneration of an intermediate fuel vapor storage unit in an internal combustion engine, the method including the steps of:

performing gasoline direct injection in lean mode;

supplying stored fuel vapor to the internal combustion engine in the form of the regeneration gas via a controllable tank venting valve;

determining the fuel content of the regeneration gas in accordance with a signal of an exhaust gas analyzer probe in an exhaust gas of the internal combustion engine;

performing, with a closed tank venting valve, an adjustment between the signal of the exhaust gas analyzer probe and a preselected setpoint in which the exhaust gas analyzer probe signal is combined with a correction quantity while the tank venting valve is closed so that a result of the combination corresponds to the setpoint;

combining, with an open tank venting valve, the exhaust gas analyzer probe signal with the correction quantity; and determining a regeneration gas charge from the result of the combination.

10. The electronic control system according to claim 9, wherein the method further includes the steps of:

forming a measured lambda value from the exhaust gas analyzer probe signal; and determining and integrating a difference of the measured lambda value from a product of an adjustment factor and a difference of a lambda setpoint from value 1.

11. The electronic control system according to claim 10, wherein the adjustment factor in a steady state corresponds to an average quotient in accordance with:

(measured lambda value−1)/(lambda setpoint value−1).

12. The electronic control system according to claim 10, wherein the method further includes the step of determining an actual lambda in accordance with the following equation during operation with the open tank venting valve:

actual lambda=(1/adjustment factor)*(measured lambda value−1)+1.

13. The electronic control system according to claim 9, wherein the method further includes the step of performing an adjustment in stratified mode upon one of a change in an operating point of the internal combustion engine and a change in ambient conditions.

14. The electronic control system according to claim 13, wherein the ambient conditions include an ambient temperature and an elevation at which the internal combustion engine is operated.

15. The electronic control system according to claim 13, wherein the change in the operating point includes a minimum change in a lambda setpoint.

16. The electronic control system according to claim 10, wherein the method further includes the step of completing an adjustment when an absolute value of an integrator input drops below a preselected threshold value.

* * * * *